US006880373B2

(12) United States Patent
Ling

(10) Patent No.: US 6,880,373 B2
(45) Date of Patent: Apr. 19, 2005

(54) LAPTOP COMPUTER LOCK HAVING A TAPERED EXTENSION EXTENDING OUT TO ALLOW A SECURING DEVICE TO SECURELY LOCK THE LAPTOP COMPUTER WITHOUT TILTING THE LAPTOP COMPUTER

(75) Inventor: Renny Tse-Haw Ling, Chung-Ho (TW)

(73) Assignee: Sinox Co., Ltd., Chung-Ho (TW)

( * ) Notice: Subject to any disclaimer, the term of this patent is extended or adjusted under 35 U.S.C. 154(b) by 0 days.

(21) Appl. No.: 10/373,830

(22) Filed: Feb. 27, 2003

(65) Prior Publication Data

US 2004/0168486 A1 Sep. 2, 2004

(51) Int. Cl.[7] ..... E05B 69/00; E05B 73/00
(52) U.S. Cl. ..... 70/58; 70/57.1
(58) Field of Search ..... 70/57.1, 58, 14, 70/18; 248/551, 553

(56) References Cited

U.S. PATENT DOCUMENTS 3,722,239 A * 3/1973 Mestre ..... 70/212
5,875,657 A * 3/1999 Kelley ..... 70/18
6,257,029 B1 * 7/2001 Liao ..... 70/58
6,305,199 B1 * 10/2001 Igelmund ..... 70/58
6,321,579 B1 * 11/2001 Reyes ..... 70/58
6,418,759 B1 * 7/2002 Zeren et al. ..... 70/58
6,463,770 B1 * 10/2002 Lee ..... 70/58
6,513,350 B1 * 2/2003 Hurd et al. ..... 70/58
6,619,081 B1 * 9/2003 Yu ..... 70/58

* cited by examiner

*Primary Examiner*—John B. Walsh
(74) *Attorney, Agent, or Firm*—Winston Hsu

(57) ABSTRACT

A laptop computer lock includes a primary body having a tapered extension extending outward from the primary body and having a through hole defined through the tapered extension. A secondary body is movably received in the primary body and has a linkage extending out of the primary body. A retaining device is received in the primary body and has a leverage operably engaged with the linkage so that the leverage is able to pivot relative to the secondary body. The tapered extension of the primary body increases available space for a securing device to secure the laptop computer without tilting the laptop computer.

14 Claims, 6 Drawing Sheets

LAPTOP COMPUTER LOCK HAVING A TAPERED EXTENSION EXTENDING OUT TO ALLOW A SECURING DEVICE TO SECURELY LOCK THE LAPTOP COMPUTER WITHOUT TILTING THE LAPTOP COMPUTER

BACKGROUND OF THE INVENTION

1. Field of the Invention

The present invention relates to a lock, and more particularly to a laptop computer lock having a tapered extension extending out to allow a securing device to lock the laptop computer without tilting the laptop computer.

2. Description of Related Art

As the fast growth of modern technology, electronic devices are becoming more compact than ever. Due to its portability, users all over the world love using these light weight and compact electronic devices. One of them which are mostly seen globally is the laptop computer. Users may use the laptop computer anywhere and anytime without limitation of any kind. Because of the portability of laptop computers, stealing events are frequently heard from friends. In order to prevent unauthorized personnel from stealing the laptop computer away, securing devices are invented and introduced to the public. U.S. Pat. No. 6,112,562 issued to Murray Jr. et. al. and U.S. Pat. No. 6,257,029 issued to Liao concern securing devices for laptop computers.

Nowadays, the securing device is able to be connected to a built-in hole (approximately 3×7 cm) in a side face of the laptop computer so as to lock the laptop computer as required. However, when the conventional securing device is employed, there is a drawback that suffers the user.

With reference to FIGS. 1A and 1B, normally, a conventional lock (1) securely attached to a side face of the laptop computer (A) incorporates a securing device (10) having a cable (11) and a securing block (12) to lock the laptop computer (A). It is noted that the lock (1) has a width (L1) and a distance from the lock (1) to a surface supporting the laptop computer is (S1). If the securing device (10) is to lock the laptop computer (A), the cable's length has to be larger than the width (L1) of the lock (1), otherwise, the cable (11) won't be able to extend through the through hole **(1*a*) in the lock (1)**.

Still, if the through hole **(1*a*) is vertical to the surface applied to support the laptop computer (A) and the radius of the cable's curvature is larger than the distance (S1), the laptop computer (A) is tilted with respect to the surface to support the laptop computer (A). If the securing block (12) has a length larger than the distance (S1), the laptop computer (A) is tilted as well. Still again, only if the radius of the cable's curvature is smaller than the distance (S1) or the cable (11)** is replaced with a much smaller padlock, the problem of tilting the laptop computer (A) exists. However, using a much smaller padlock or a thinner cable than required seems not adequate to secure the laptop computer (A).

To overcome the shortcomings, the present invention tends to provide an improved laptop computer to mitigate and obviate the aforementioned problems.

SUMMARY OF THE INVENTION

The primary objective of the present invention is to provide an improved laptop computer lock having a tapered extension extending out of the lock to define a space between a side face of the lock to receive therein a securing device so that after the securing device is attached to the lock, the laptop computer will not be tilted by the securing device.

Another objective of the present invention is to provide an improved laptop computer lock having a primary body and a secondary body slidably connected to the primary body. The primary body has a first through hole and the secondary body has a second through hole selectively aligned with the first through hole so that the securing device is able to extend through the aligned first through hole and the second through hole to secure the laptop computer.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
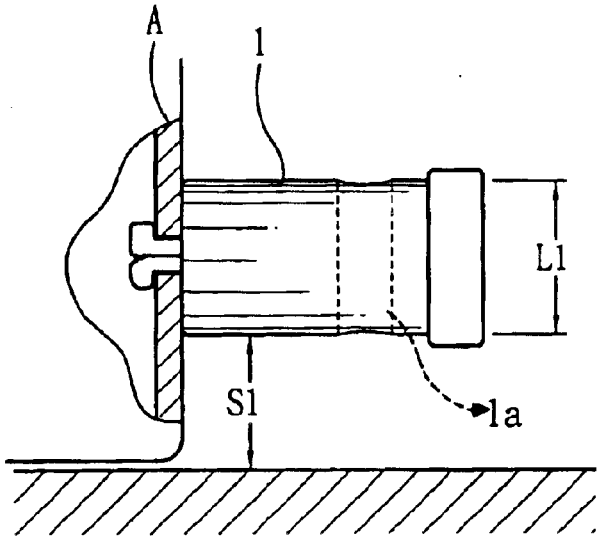
Fig. 1A PRIOR ART
FIG. 1A is a side plan view showing a conventional laptop computer lock incorporated with a securing device.
Figure 1B:
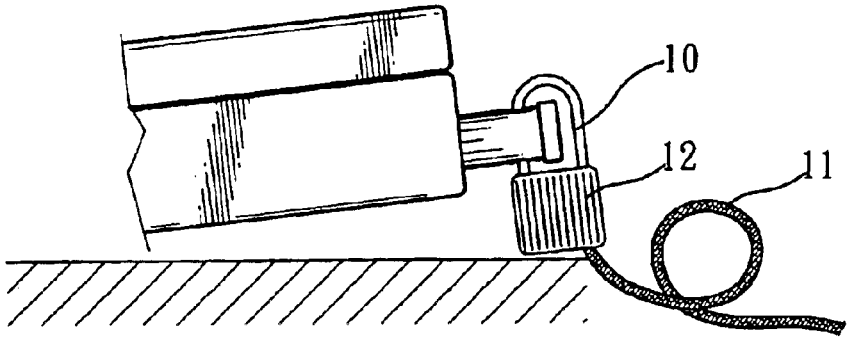
Fig. 1B PRIOR ART
FIG. 1B is a schematic view showing that the conventional laptop computer lock is very close to a surface to support the laptop computer.
Figures 2, 3:
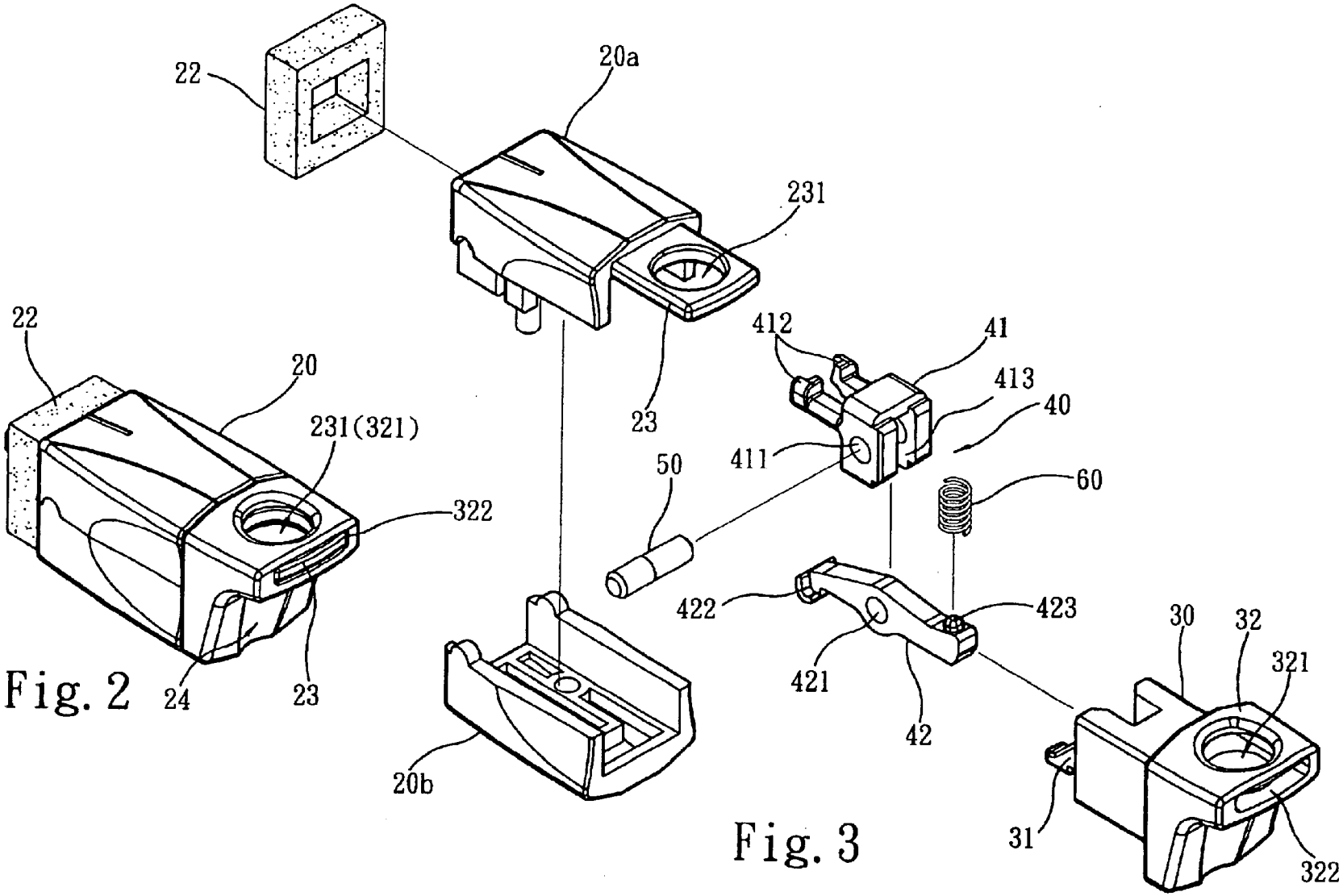
FIG. 2 is a perspective view of the lock of the present invention.
FIG. 3 is an exploded perspective view of the lock in FIG. 2.
Figure 4:
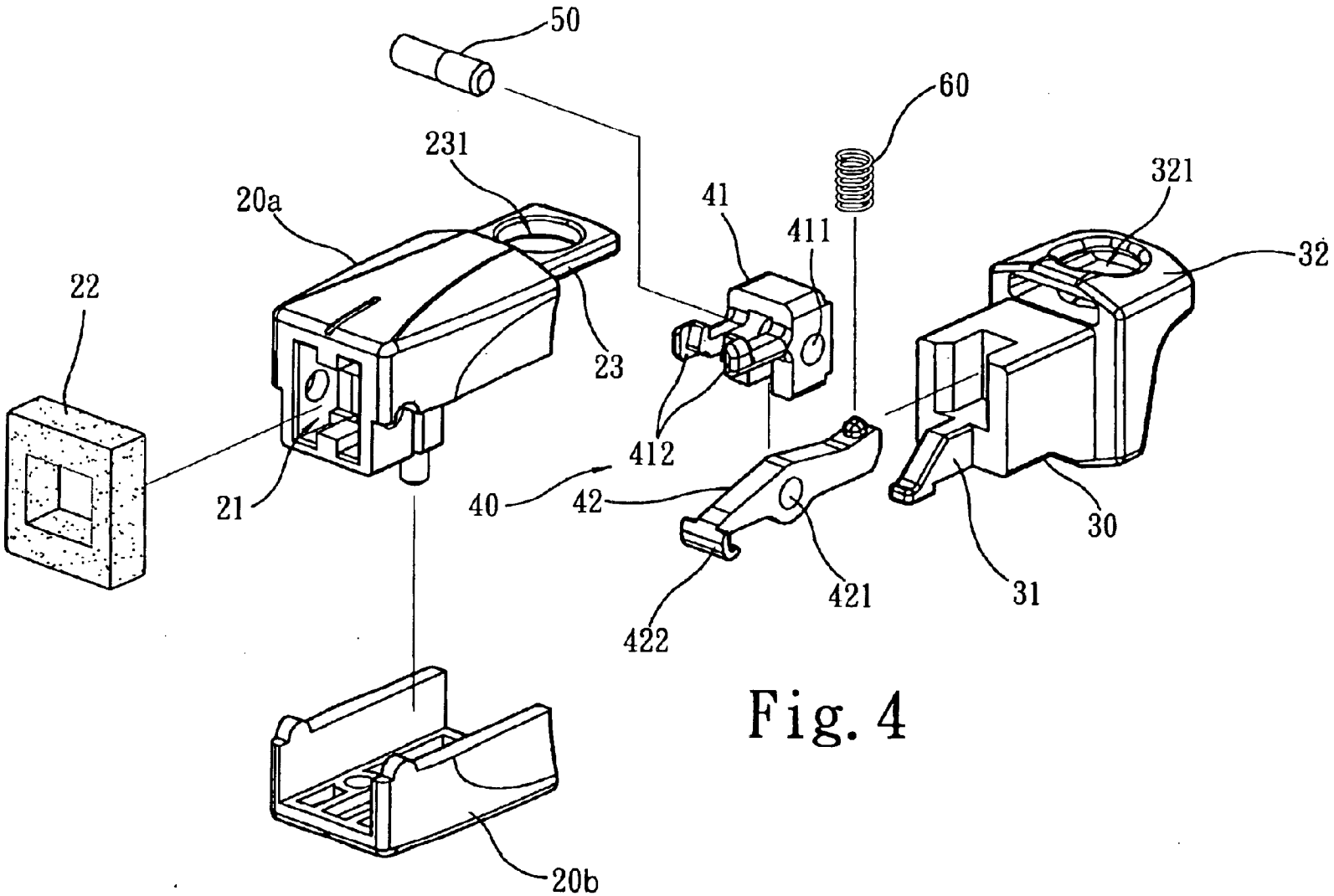
FIG. 4 is an exploded perspective view of the lock in FIG. 2, wherein the angle of this exploded perspective view is not the same as that of FIG. 3 so that hidden elements in FIG. 3 are shown.

With reference to FIGS. 2, 3 and 4, the lock in accordance with the present invention has a primary body (20), a secondary body (30) and a retaining device (40).

The primary body (20) includes a top casing **(20*a*) and a bottom casing (20*b*) securely connected to the top casing (20*a*) to form the primary body (20). The top casing (20*a*) has a passage (21), a cushion (22) attached to a side face defining the passage (21) and a tapered extension (23) extending out from the primary body (20*a*). The tapered extension (23) has a first through hole (231) defined through the extension (23)**.

The secondary body (30) has a linkage (31) integrally formed with the secondary body (30) and extending out from the secondary body (30) and a ledge (32) extending out from the secondary body (30) in a direction opposite to the direction of the linkage (31). The ledge (32) has a second through hole (321) defined through the ledge (32) to selectively aligned with the first through hole (231) of the primary body (20). A slot (322) is defined through the ledge (32) to communicate with the second through hole (321) so as to receive therein the tapered extension (23) when required.

The retaining device (40) includes a fixed block (41) and a leverage (42). The fixed body (41) is securely sandwiched between the top casing (20*a*) and the bottom casing (20*b*) and has a first pin hole (411) laterally defined through the fixed block (41) to allow a pin (50) to extend through the first pin hole (411), two securing legs (412) extending from the fixed block (41) and out of the top casing (20*a*) from the passage (21) and a cutout (413) defined to communicate with the first pin hole (411). The leverage (42) has a second pin hole (421) defined in a mediate portion thereof to align with the first pin hole (411), a hook (422) formed on one distal end thereof and a seat (423) formed on the other distal end of the leverage (42) to correspond to a spring (60).

Figure 5:
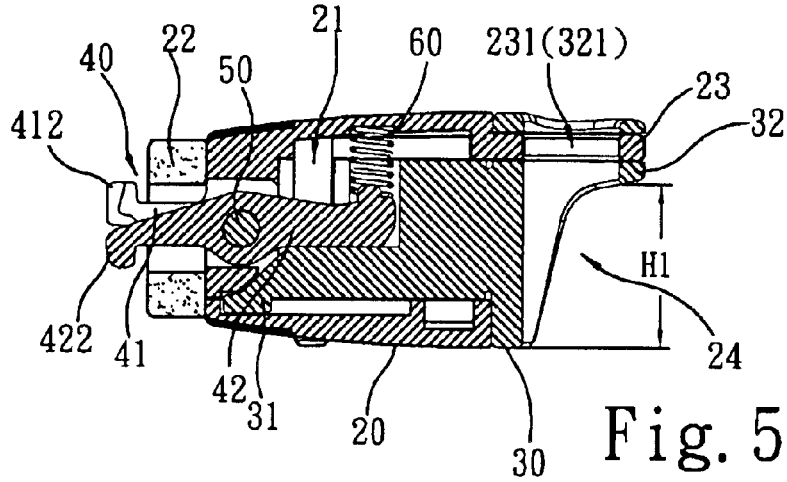
FIG. 5 is a cross sectional view of the lock by taking the line 5—5 of FIG. 2.

With reference to FIG. 5 and still taking FIGS. 3 and 4 for reference, when the lock of the present invention is in assembly, the cushion (22) is securely attached to the side face defining the passage (21). The leverage (42) is received in the cutout (413) to have the second pin hole (421) aligned with the first pin hole (411) such that the pin (50) is able to extend through the aligned first pin hole (4110 and the second pin hole (421). Then, the combination of the fixed block (41) and the leverage (42) is sandwiched between the top casing (20*a*) and the bottom casing (20*b*) with two distal ends of the pin (50) abutting to an inner surface of the primary body (20). Due to the provision of the cutout (413) in the fixed block (41), the leverage (42) is pivotal relative to the fixed block (41). Furthermore, before the combination of the fixed block (41) and the leverage (42) is sandwiched between the top casing (20*a*) and the bottom casing (20*b*), the spring (60) is mounted on top of the seat (423). Therefore, after the combination of the fixed block (41) and the leverage (42) is received in the primary body (20), the free end of the spring (60) abuts a bottom surface of the top casing (20*a*).

Figure 6A:
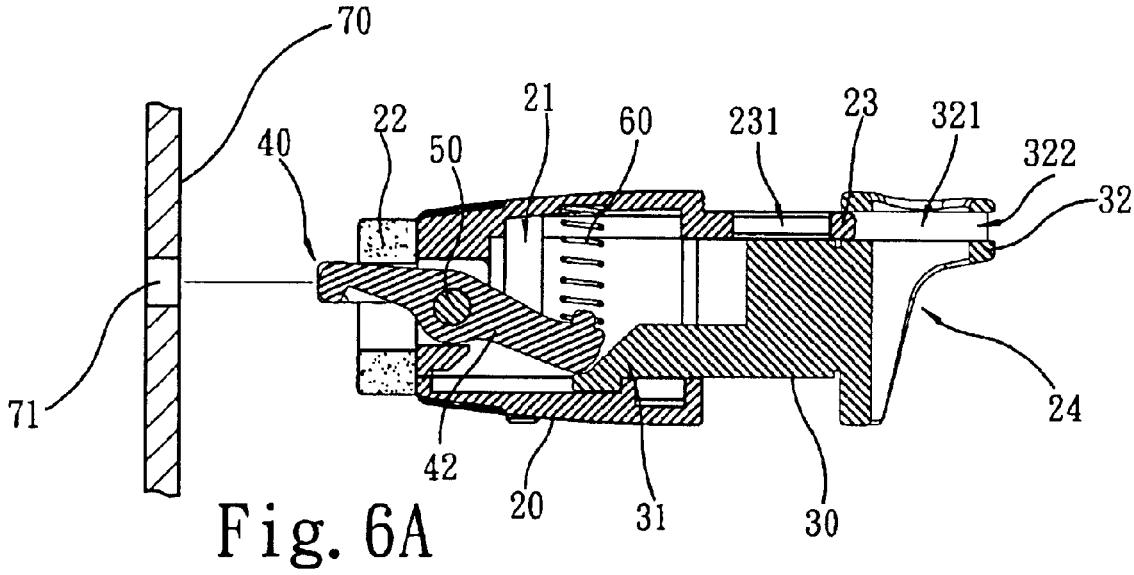
FIG. 6A is a schematic view of the lock, wherein the lock is in a released status.

Then the secondary body (30) is assembled with the primary body (20) with the retaining device (40) received in the primary body (20). The tapered extension (23) extends into the slot (322) to align the first through hole (231) to the second through hole (321). Meanwhile, the linkage (31) is on the bottom of the leverage (42). When the foregoing assembly is finished, the lock of the present invention is formed. It is to be noted that the hook (422) and the securing legs (412) extend out of the lock to be ready to extend into a built-in port (71) in a back surface of a computer (70), as shown in FIG. 6A.

When the user is ready to leave the computer unattended for a short while, the user is able to slide the secondary body (30) to misalign the first through hole (231) and the second through hole (321). Because the slide of the secondary body (30), the leverage (42) pivots by the urging force of the spring (60) so that the hook (422) is aligned with the securing legs (412). After the user inserts the aligned securing legs (412) and the hook (422) into the port (71), the user slides the secondary body (30) back relative to the primary body (20) to re-align the first through hole (231) and the second through hole (321). Meanwhile, the hook (422) leaves the securing legs (412) due to the pivotal movement of the leverage (42) due to the linkage (31) being on the bottom of the leverage (42) again.

Figure 6B:
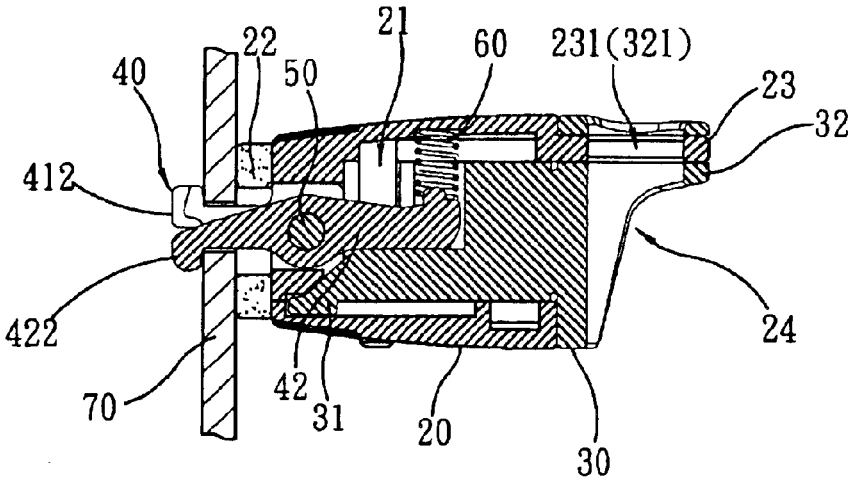
FIG. 6B is a schematic view of the lock, wherein the lock is in an engaged status.

With reference to FIG. 6B, after the hook (422) leaves the securing legs (412), the lock securely connected to a side face defining the port (71).

Figure 7:
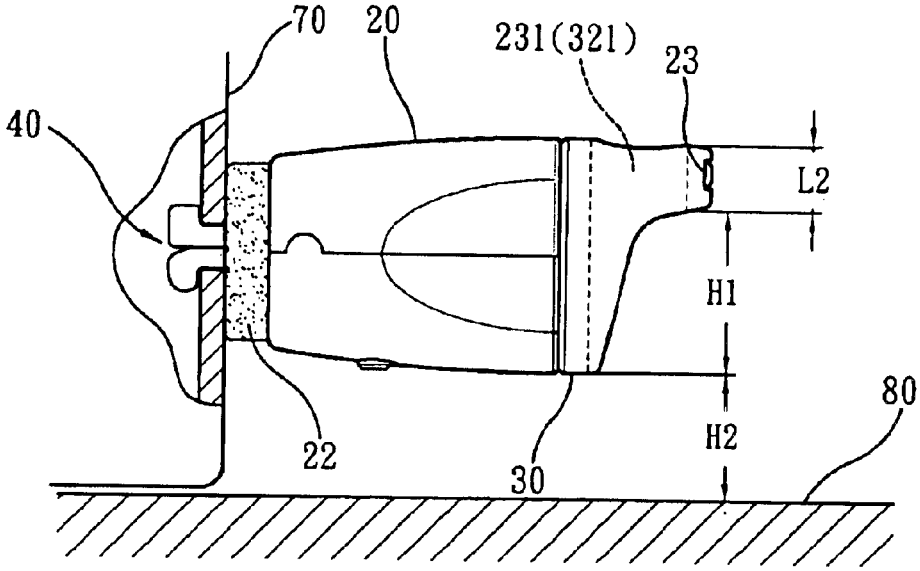
FIG. 7 is a schematic view of the lock of the present invention showing that a space is defined beside the lock.

With reference to FIG. 7 and taking FIG. 5 into consideration, after the lock of the present invention is securely connected to the side face of the port (71), a space (24) is defined between a bottom face of the ledge (32) and a bottom face of the secondary body (30). From the depiction of FIG. 5, it is noted that ledge (32) is also tapered so that the space (24) has a height H1. Because the port (71) is always defined in a position away from a bottom face of the computer (70), e.g. H2. A total height of H1 plus H2 is thus formed between the ledge (32) and a surface (80) where the computer is situated. Furthermore, if a depth L2 of the aligned first through hole (231) and the second through hole (321) is taken into consideration, the total available height is then L2+H1+H2.

Figure 8:
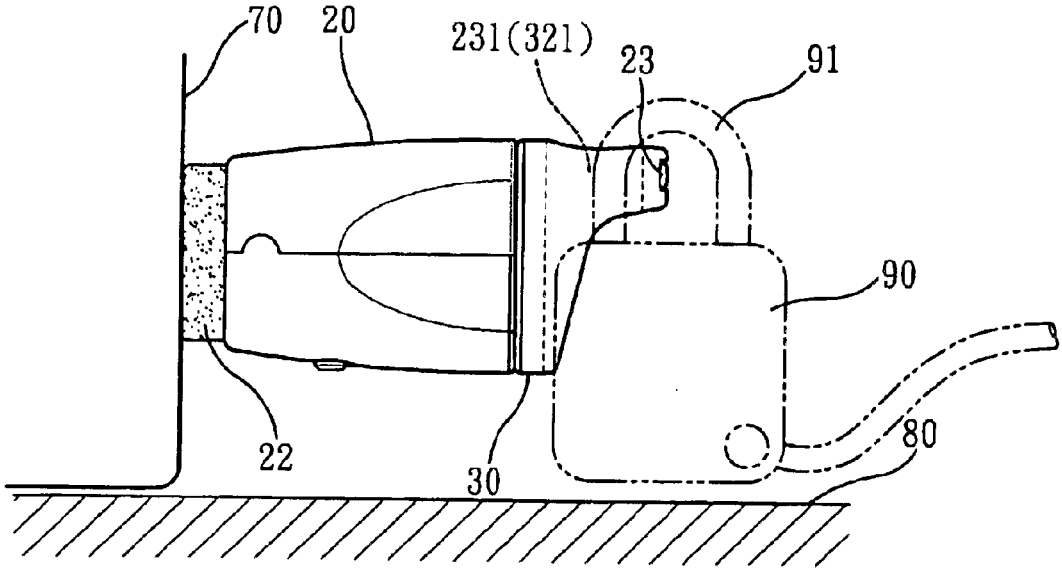
FIG. 8 is a schematic view of the lock of the present invention showing that the space defined is able to receive therein a securing device without tilting the laptop computer.

With reference to FIG. 8, after the assembly of the lock, the user is then able to use a securing device (90) such as a pad lock or the like to extend through the aligned first through hole (231) and the second through hole (321) so that a relative position between the primary body (20) and the secondary body (30) is secured. Because the available height is increased, after the securing device (90) is added to the lock of the present invention, the computer will not be tilted by the securing device (90).

Figure 9:
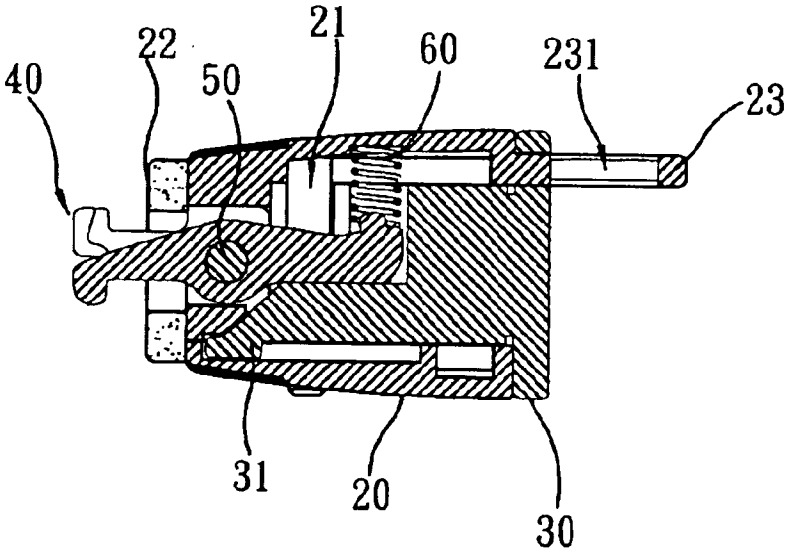
FIG. 9 is a schematic view showing another embodiment of the lock of the present invention.

With reference to FIG. 9, it is noted that the ledge (32) together with the second through hole (321) of the secondary body (30) is removed. Thus, when the secondary body (30) is slid into the primary body (20), the first through hole (231) is exposed to allow the extension of the securing device (90).

Other embodiments may be made possible after reading the specification of this application. However, there are numerous kinds of combination between the primary body (20) and the secondary body (30). Other means including rotating the secondary body (30) relative to the primary body (20) to accomplish the purpose of aligning the first through hole (231) with the second through hole (321) should be included in the domain of this application.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A laptop computer lock comprising:

a primary body having a tapered extension tapered from a bottom for defining a space and extended outward from the primary body and having a through hole defined through the tapered extension;

a secondary body movably received in the primary body and having a linkage extending out of the primary body, the tapered extension extended from the primary body where being in between the primary body and the secondary body; and a retaining device received in the primary body and having a leverage operably engaged with the linkage so that the leverage is able to pivot relative to the secondary body, wherein leverage has a hook formed on one distal end of the leverage and extending out of the primary body, whereby the tapered extension of the primary body increases the available space for a securing device to secure the laptop computer without tilting the laptop computer.

2. The laptop computer lock as claimed in claim 1, wherein the primary body has a passage defined to allow extension of the hook.

3. The laptop computer lock as claimed in claim 1, wherein the retaining device has a pair of securing legs extending out of the primary body.

4. The laptop computer lock as claimed in claim 2, wherein the retaining device has a pair of securing legs extending out of the primary body from the passage.

5. The laptop computer lock as claimed in claim 1, wherein the retaining device further has a fixed block securely received in the primary body and having a pair of securing legs extending out of the primary body and a first pin hole, the leverage has a second pin hole defined to align with the first pin hole so that a pin is able to extend through the aligned first pin hole and the second pin hole to abut an inner surface of the primary body to secure position of the fixed block and to allow pivotal movement of the leverage.

6. The laptop computer lock as claimed in claim 5, wherein the leverage has a hook formed on one distal end of the leverage and extending out of the primary body and a scat formed on the other distal end of the leverage so that a spring is able to be mounted on top of the scat and to abut an inner surface of the primary body to provide a recovery force to the leverage.

7. The laptop computer lock as claimed in claim 6, wherein the primary body has a passage defined to allow extension of the hook.

8. The laptop computer lock as claimed in claim 7, wherein the retaining device has a pair of securing legs extending out of the primary body.

9. The laptop computer lock as claimed in claim 8, wherein the retaining device has a pair of securing legs extending out of the primary body from tho passage.

10. The laptop computer lock as claimed in claim 5, wherein the secondary body has a ledge extending out in a direction opposite to a direction of the linkage and having a second through hole defined to selectively align with the through hole of the tapered extension.

11. The laptop computer lock as claimed in claim 10, wherein the leverage has a hook formed on one distal end of the leverage and extending out of the primary body and a seat formed on the other distal end of the leverage so that a spring is able to be mounted on top of the sent and to abut an inner surface of the primary body to provide a recovery force to the leverage.

12. The laptop computer lock as claimed in claim 11, wherein the primary body has a passage defined to allow extension of the hook.

13. The laptop computer lock as claimed in claim 12, wherein the retaining device has a pair of securing legs extending out of the primary body.

14. The laptop computer lock as claimed in claim 13, wherein the retaining device has a pair of securing legs extending out of the primary body from the passage.

* * * * *